United States Patent [19]

Whittaker

[11] 4,386,444

[45] Jun. 7, 1983

[54] BUFFING MACHINE PAD CLEANING DEVICE

[76] Inventor: Richard E. Whittaker, 302 S. Croton Ave., New Castle, Pa. 16103

[21] Appl. No.: 322,958

[22] Filed: Nov. 19, 1981

[51] Int. Cl.[3] ..... A46B 17/00

[52] U.S. Cl. ..... 15/257 R; 15/142

[58] Field of Search ..... 15/142, 257 R

[56] References Cited

U.S. PATENT DOCUMENTS 2,581,346 1/1952 Autry ..... 15/142 X 4,037,287 7/1977 Whittaker ..... 15/257 R

*Primary Examiner*—Peter Feldman

*Attorney, Agent, or Firm*—Harpman & Harpman

[57] ABSTRACT

A device on which a rotary floor buffing machine may be positioned and operated to remove built up accumulations of wax and dirt from the buffing pad thereof arranges a slightly elevated flat machine receiving area defined by a circular wire grille having a plurality of radially positioned bars extending from an elevated center section to a plurality of circumferentially spaced raised support members with the area beneath the circular grille being open and capable of receiving wax and dirt removed from the buffing pad throughout the area.

6 Claims, 3 Drawing Figures

BUFFING MACHINE PAD CLEANING DEVICE

BACKGROUND OF THE INVENTION (1) Field of the Invention

This invention relates to devices for cleaning the pads of floor buffing machines.

(2) Description of the Prior Art

The only prior art structure usable with a floor buffing machine for the indicated purpose comprises the buffing machine pad cleaning device shown in U.S. Pat. No. 4,037,287 of July 26, 1977. The device disclosed in that patent performed satisfactorily under most conditions and particularly when the direction of rotation of the buffing pad being cleaned conformed with the curved configuration of the radially arranged bars 17 on which the buffing machine cleaning pad was positioned. Counter rotation of the buffing machine pad did not sufficiently flex the fibers of the buffing machine pad at all times to remove all of the wax and dirt accumulation. Additionally, the areas of the flat top platform 10 between the plurality of openings 15 therein that were immediately adjacent the bars 17 built up objectionable accumulations of wax and dirt, some of which was transferred back to the buffing machine pad with the result that the device of the patent did not always effectively clean the buffing machine pad as was intended.

The references cited in my Patent 4,027,287 and comprising the U.S. Pat. Nos. 1,898,887, 2,764,776, 2,997,620 and 3,158,889 are the closest other art known.

This invention provides an improved buffing machine pad cleaning device wherein the buffering machine and the pad thereof is positioned directly on a circular wire grille formed of a plurality of circumferentially spaced radially extending wire rods, the grille being almost completely spaced above the wax and dirt receiving portions of the machine so that the action of the buffing machine pad being rotated on the grille will free the pad of dirt and wax which can then fall freely to the collection area therebeneath with no intervening structure.

SUMMARY OF THE INVENTION

A buffing machine pad cleaning device is disclosed which includes a slightly elevated flat wire grille formed of a plurality of circumferentially spaced radially extending straight wires or bars with a completely open area therebeneath providing a receptacle for wax and dirt removed by the operation of the floor buffing machine thereon with the buffing pad rotating against the radially positioned bars.

DESCRIPTION OF THE PREFERRED EMBODIMENT

Figure 1:
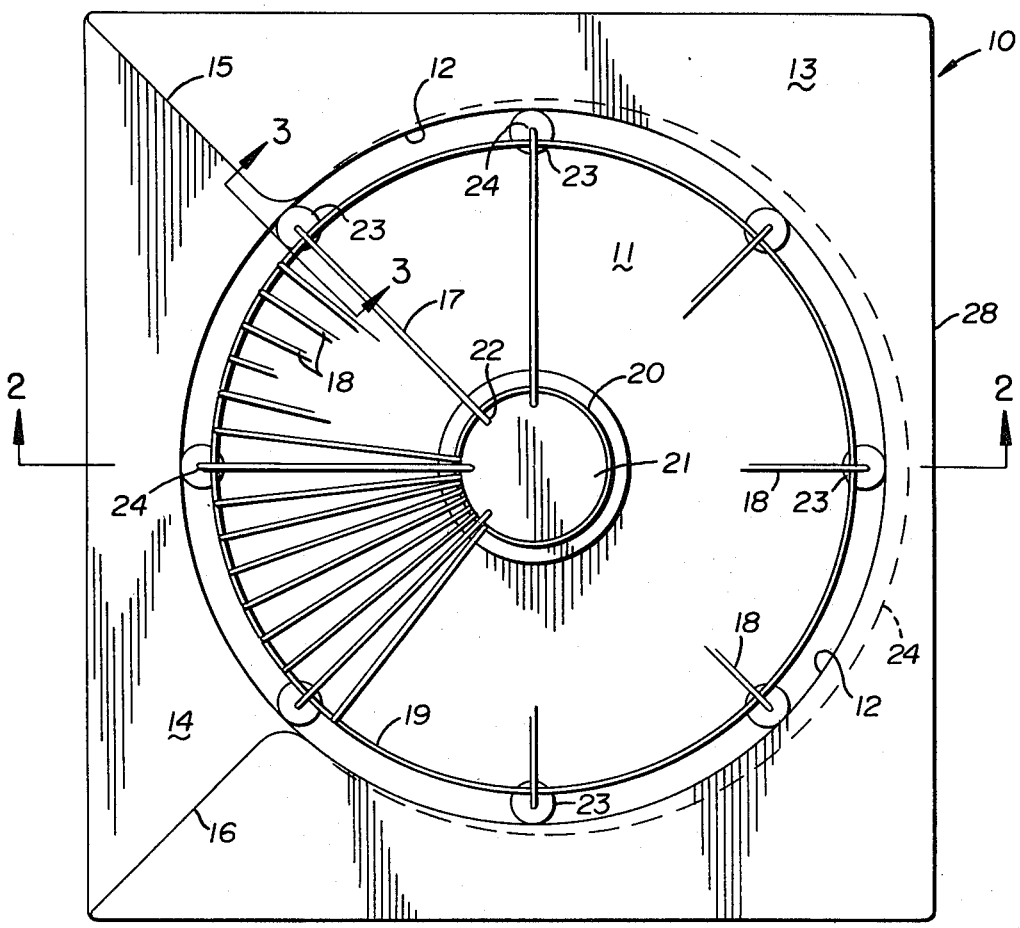
FIG. 1 is a top plan view of the buffing machine pad cleaning device.

In the form of the invention chosen for illustration herein, the buffing machine pad cleaning device comprises a molded fiberglass substantially square body 10 defining a large circular depressed flat bottom receptacle area 11. Three-fourths of the circular receptacle area 11 being additionally defined by an upwardly inclined wall 12 and a flat surrounding top portion 13. The fourth side of the substantially square body 10 has a flat surface 14 extending between oppositely disposed angular shoulders 15 and 16 which form slightly tapered upstanding extensions of the inclined wall 12 and provide guides by which a floor buffing machine and the buffing pad thereon may be guided onto the device of the invention and specifically onto a wire grille 17 formed of a plurality of radially positioned, circumferentially spaced wire bars 18 joined adjacent their outer ends to a circular wire frame 19 and adjacent their inner ends to a secondary wire frame 20.

The centermost portion of the large circular flat bottom receptacle area 11 has a raised circular portion 21 with several openings therein in which downturned ends 22 on several of the bars 18 register so as to retain the wire grille 17 in fixed relation thereto.

Figure 2:
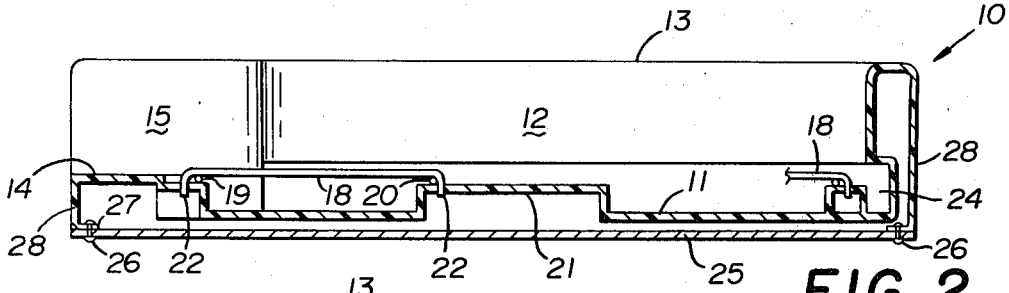
FIG. 2 is a vertical section on line 2—2 of FIG. 1.
Figure 3:
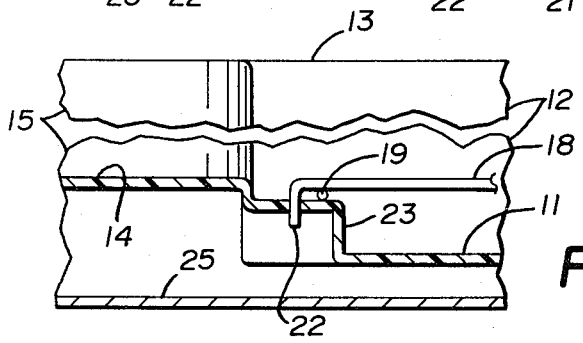
FIG. 3 is an enlarged cross sectional detail of a portion of the device seen in FIGS. 1 and 2 of the drawings.

In FIGS. 1, 2 and 3 of the drawings, a plurality of circumferentially spaced raised support members 23 may be seen and several of the bars 18 have downturned outer ends 22 registering in openings in these raised support members 23.

By referring now to FIG. 2 of the drawings, it will be seen that the upper half of the upperwardly inclined wall 12 is offset inwardly with respect to the lower portion thereof forming a semi-circular recess 24 as also indicated in broken lines in FIG. 1 of the drawings. In effect, the projecting or offset portion of the upwardly inclined three-quarter circular wall 12 thus forms a shield with respect to particles of wax and dirt that are freed from the buffing machine pad and thrown outwardly by the centrifugal motion of the buffing machine rotating the pad on the device of the invention.

Referring again to FIG. 2 and FIG 3 of the drawings, it will be seen that a substantially square bottom plate 25 also formed of molded fiberglass resin is attached by fasteners 26 to inturned flanges 27 on the substantially outer vertical walls 28 of the substantially square body 10 of the device.

It will be seen that the concept of the invention as disclosed herein makes it possible to rapidly and economically form the two main body portions 10 and 25 of the device by molding the same of suitable fiberglass resin compositions to provide a smooth easily maintained substantially strong article which will receive and hold the wire grille 17 in predetermined relation with nothing underneath the bars 18 of the grille 17 to interfere with or enable build up of wax and dirt particles removed from the buffing machine pad rotated thereon.

It will also be seen that the formation of the bars 18 in radial configurations, on straight lines, enables the device to be used with clockwise and counter clockwise rotating buffing machines with equal effectiveness in flexing the fibers of the buffing pads so as to remove the wax and dirt particles therefrom which makes it possible to continuously reuse the buffing machine pads rather than disgarding them and using new buffing machine pads as has heretofore been the case.

It will thus be seen that a simple and efficient device for cleaning the pads of floor buffing machines has been disclosed and having thus described my invention what I claim is:

1. A buffing machine pad cleaning device comprising a body member having a large circular flat bottom receptacle area formed therein, a central portion of the flat bottom receptacle area being raised, the area of the raised central portion being of a diameter approximately one-fifth of the diameter of the circular flat bottom receptacle area, a plurality of circumferentially spaced raised supports on said circular flat bottom receptacle area adjacent the peripheral edge thereof and a wire grille comprised of outer and inner circular wire frames and a plurality of circumferentially spaced radially positioned wire bars affixed thereto, the ends of some of said bars being downturned and engaged in openings in said central portion and raised supports respectively so as to position said wire grille substantially above said flat bottomed receptacle area, an upwardly extending wall positioned about three-quarters of said circular flat bottom receptacle area, said wall having a substantially flat outturned flange extending into a downturned peripheral edge flange.

2. The buffing machine pad cleaning device set forth in claim 1 and wherein said wire grille is of a diameter less than the diameter of said circular glat bottom receptacle area.

3. The buffing machine pad cleaning device set forth in claim 1 and wherein a portion of said upwardly extending wall is offset inwardly so as to overlie a portion of said flat bottom receptacle area.

4. The buffing machine pad cleaning device set forth in claim 1 and wherein the peripheral edge flange is inturned at its lower edge and a substantially flat bottom member is affixed thereto.

5. The buffing machine pad cleaning device set forth in claim 1 wherein said body member is substantially square and said upwardly extending wall positioned about three quarters of said circular flat bottom receptacle area extends outwardly respectively in oppositely disposed angular walls to the corners of said square body member so as to form a tapered throat and guides directed toward said flat bottom receptacle area.

6. The buffing machine pad cleaning device set forth in claim 1 and wherein the body member, the circular flat bottom receptacle area formed therein, the central portion and the raised supports are integrally molded of fiberglass reinforced resin.

* * * * *